US006823671B2

(12) United States Patent
Achten

(10) Patent No.: US 6,823,671 B2
(45) Date of Patent: Nov. 30, 2004

(54) FREE-PISTON UNIT FOR GENERATING HYDRAULIC ENERGY

(75) Inventor: Peter A. J. Achten, Eindboven (NL)

(73) Assignee: Innas Free Piston B.V., Ae Breda (NL)

( * ) Notice: Subject to any disclaimer, the term of this patent is extended or adjusted under 35 U.S.C. 154(b) by 0 days.

(21) Appl. No.: 10/169,328

(22) PCT Filed: Dec. 22, 2000

(86) PCT No.: PCT/NL00/00955

§ 371 (c)(1),
(2), (4) Date: Jun. 27, 2002

(87) PCT Pub. No.: WO01/49998

PCT Pub. Date: Jul. 12, 2001

(65) Prior Publication Data

US 2003/0051682 A1 Mar. 20, 2003

(30) Foreign Application Priority Data

Dec. 30, 1999 (NL) ..... 1013996

(51) Int. Cl.[7] ..... F02B 71/04
(52) U.S. Cl. ..... 60/413; 60/419
(58) Field of Search ..... 60/413, 414, 416, 60/419

(56) References Cited

U.S. PATENT DOCUMENTS 3,606,591 A * 9/1971 Potma ..... 417/364
6,116,138 A * 9/2000 Achten ..... 91/6.5

FOREIGN PATENT DOCUMENTS

| | | | |
|---|---|---|---|
| NL | 6814405 | 4/1970 | |
| WO | WO 98/54450 | 12/1998 | |
| WO | WO 98/54468 | 12/1998 | |
| WO | WO 9854468 A1 * | 12/1998 | ..... F04B/49/00 |

* cited by examiner

*Primary Examiner*—Thomas E. Lazo
(74) *Attorney, Agent, or Firm*—St. Onge Steward Johnston & Reens, LLC

(57) ABSTRACT

The invention relates to a free-piston unit for pumping fluid from a low pressure to a high pressure. The free piston is displaced by a hydraulic part under the influence of the fluid pressure on a plunger which is connected to a combustion piston. The force exerted on the plunger by the fluid pressure in a pressure chamber during the compression stroke can be set using conversion means by setting a third pressure for fluid which is to be displaced via a pressure chamber from the first fluid source to the second fluid source.

10 Claims, 8 Drawing Sheets

FREE-PISTON UNIT FOR GENERATING HYDRAULIC ENERGY

The invention relates to a free-piston unit. A unit of this type is known from NL 6814405. The drawback of the known device is that the first, low pressure and the second, high pressure are dependent on the use of the device or the use which is being made at a specific moment of the hydraulic energy which is generated. Consequently, the unit is difficult to control, since the forces acting on the plunger cannot be set independently of the low or high pressure; with the result that the energy supplied to or extracted from the combustion piston is difficult to regulate. To avoid this drawback, the unit is designed in yet another way. It is thus possible to set the energy supplied to or extracted from the combustion piston independently of the first pressure and/or the second pressure, so that accurate control of the combustion process and also part-load operation are possible.

According to a refinement, the unit is designed in yet another way. It is thus possible to set the amount of energy supplied to the combustion pistons so that the combustion process can be controlled more successfully.

According to a refinement, the unit is designed in yet another way. This makes it easy to set the third pressure.

According to a refinement, the unit is designed in yet another way. This ensures uninterrupted use of the unit.

According to a refinement, the unit is designed in yet another way. In this way, it is easy to drive rotationally driven auxiliary equipment; such as a dynamo, a fan and the like.

According to a further refinement, the device is designed in yet another way. This improves the operation of the hydraulic transformer, since fluctuations in pressures and fluid flows are evened out.

According to one embodiment, the device is designed in yet another way. As a result, the fluid flow through the hydraulic transformer is always equal to the volume pumped to the second fluid source by the unit, so that this volume can also be known in the control unit.

According to one embodiment, the device is designed in yet another way. In this way, it is easy to set the force exerted on the plunger.

According to one embodiment, the device is designed in yet another way. As a result, the supply of fluid from the unit to the second fluid source always takes place via the hydraulic transformer, so that the supply of fluid is more or less free of pulsations which limits the energy losses and prevents pressure pulsations if there is no accumulator in the system connected to the second fluid source. It is also possible for the fluid flow to be directly adapted to the fluid flow extracted by the consumers.

The invention also comprises a device in yet another way. This makes the flow of fluid to the second fluid source more uniform.

The invention is explained below with reference to a number of exemplary embodiments and with the aid of a drawing, in which.

Figure 11:
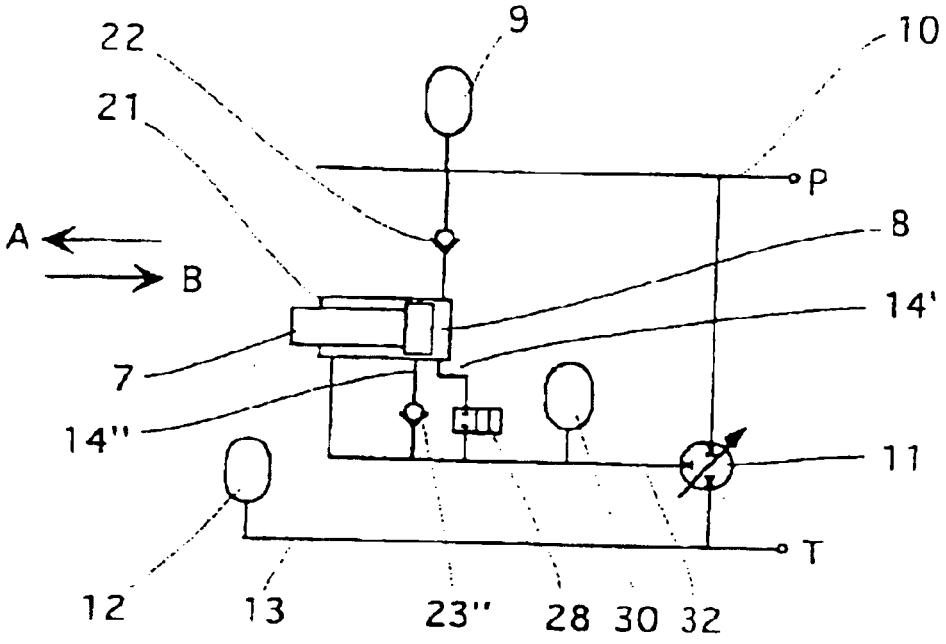
Figure 12:
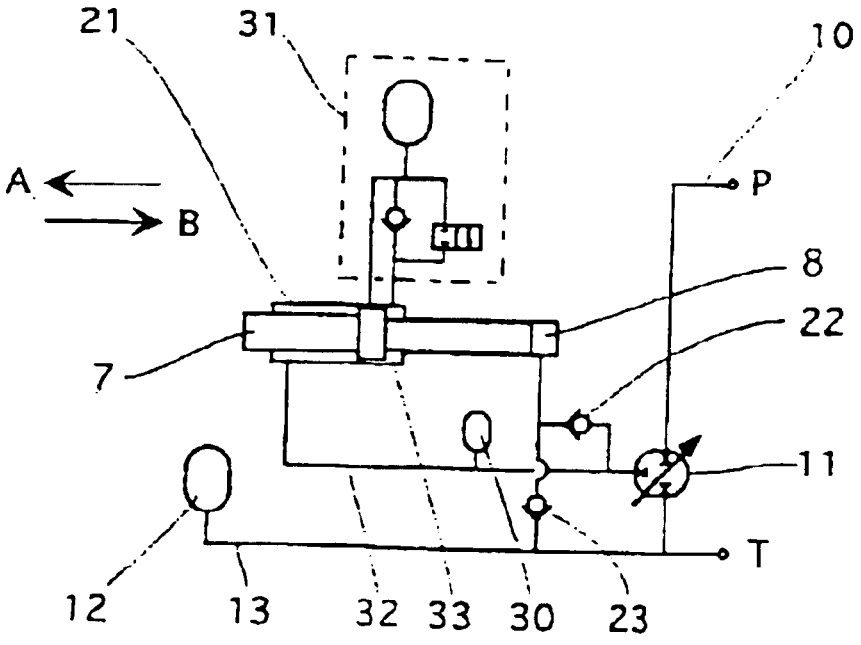
Figure 13:
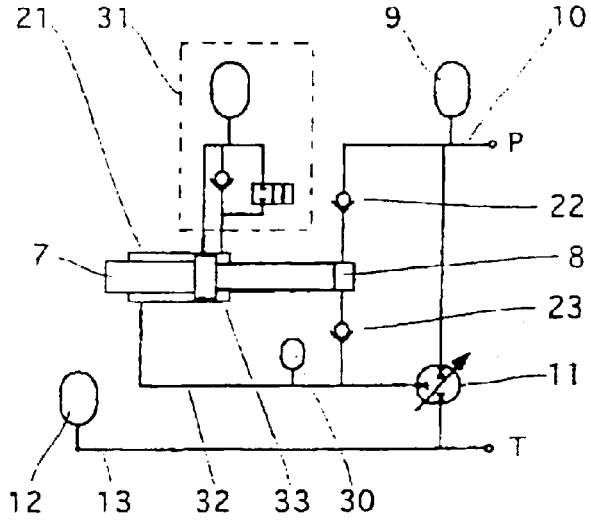
Figure 14:
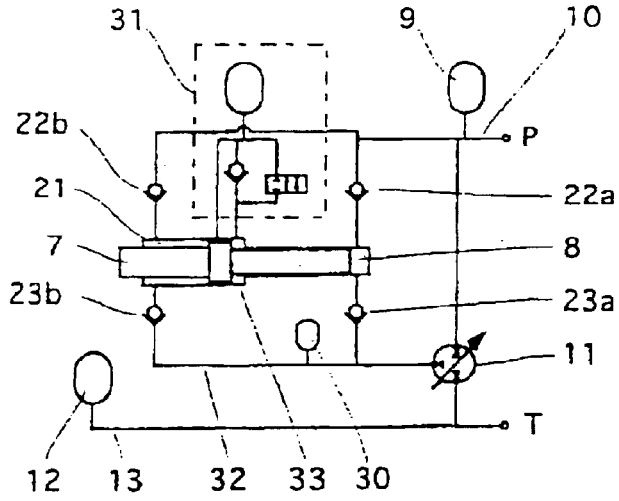
Figure 15:
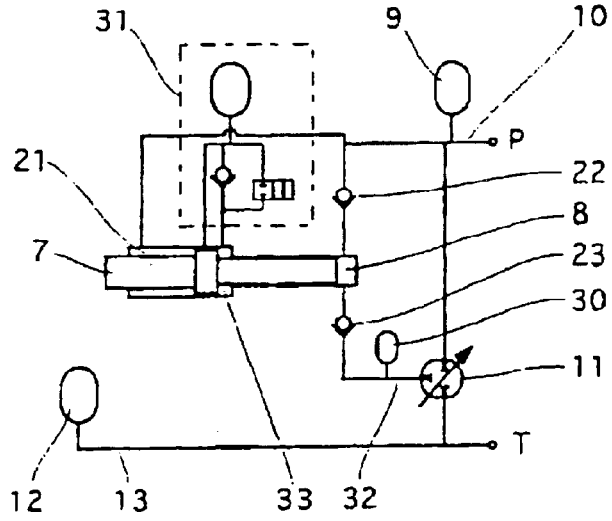
Figure 16:
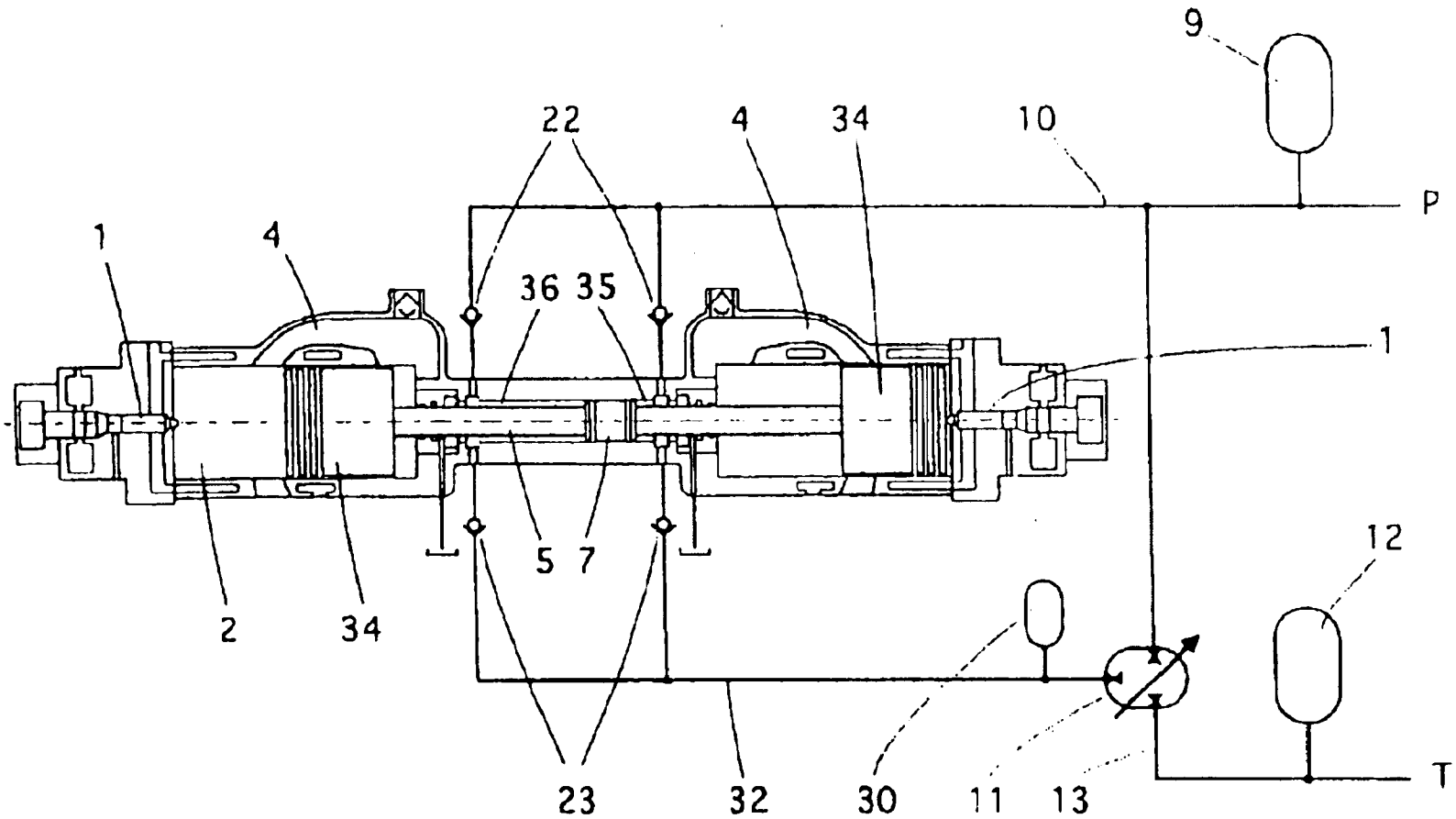

FIG. 11 diagrammatically depicts a ninth embodiment of the hydraulic part of a free-piston unit;

FIG. 12 diagrammatically depicts a tenth embodiment of the hydraulic part of a free-piston unit;

FIG. 13 diagrammatically depicts an eleventh embodiment of the hydraulic part of a free-piston unit;

FIG. 14 diagrammatically depicts a twelfth embodiment of the hydraulic part of a free-piston unit;

FIG. 15 diagrammatically depicts a thirteenth embodiment of the hydraulic part of a free-piston unit; and FIG. 16 diagrammatically depicts an exemplary embodiment of a free-piston unit with a hydraulic transformer, the two combustion pistons being movably coupled between two combustion spaces.

As far as possible, the same reference symbols are used for corresponding components throughout the various figures.

Figure 1:
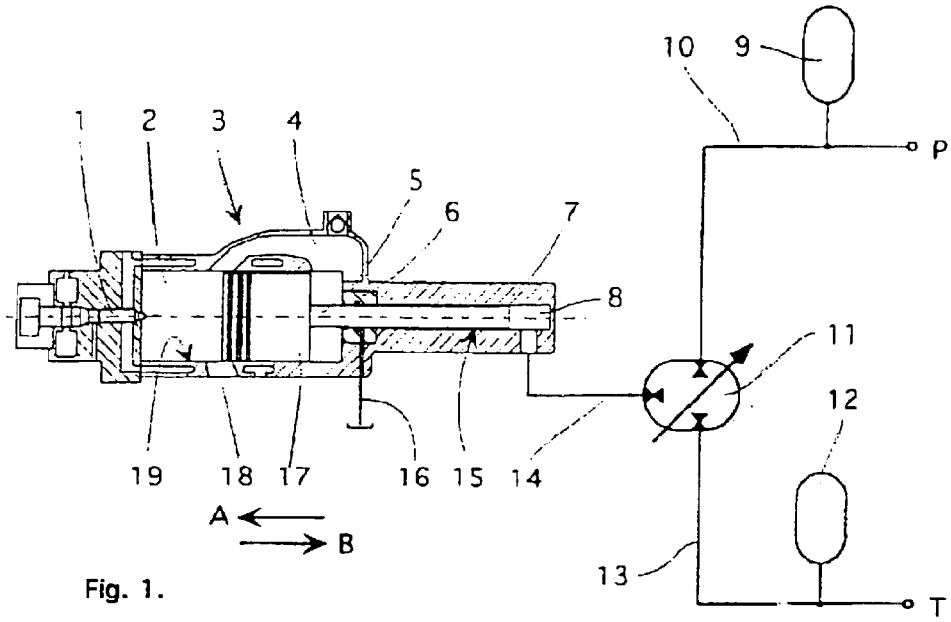
FIG. 1 shows a diagrammatic cross section through a first embodiment of a free-piston unit with a hydraulic transformer.

FIG. 1 shows a diagrammatic cross section through a free-piston unit 3 which, by means of a transformer line 14, is coupled to a hydraulic transformer 11. The free-piston unit 3 is known from earlier publications and is only outlined here. A combustion piston 17 can move in a reciprocating manner in a first cylinder 19. The first cylinder 19 is closed at one end, where it forms a combustion space 2 in conjunction with the combustion piston 17. In a known way, combustion air is introduced into the combustion space 2 by means of an air-supply device 4. During a compression stroke A, the combustion piston 17 moves toward a top dead center, the position of the combustion piston 17 in which the volume of the combustion space 2 is minimal, and, in the process, compresses the combustion air. When the combustion piston 17 is close to the top dead center, fuel is introduced into the combustion space 2 by a fuel-supply system 1. The fuel ignites on account of the high temperature of the compressed combustion air. As a result, the gas pressure in the combustion space 2 will rise and the combustion piston will move from the top dead center toward a bottom dead center. During this expansion stroke B, the combustion gases expand and the energy released during the combustion will be predominantly discharged by the combustion piston 17. The bottom dead center is the position of the combustion piston 17 in which the volume of the combustion chamber 2 is at its maximum. During the movement of the combustion piston 17 toward the bottom dead center, first of all an outlet duct 18 is opened, so that the combustion gases are able to leave the combustion space 2. Then, an air-supply duct is opened, with the result that further combustion air can flow into the combustion space 2.

The fuel-supply system 1 may be suitable for supplying fluid fuel which, for example, is atomized when injected into the combustion space. The fuel-supply system may also be suitable for supplying gaseous fuel. If appropriate, the fuel may also be ignited by spark ignition instead of by self-ignition.

A piston rod 5 is attached to the combustion piston 17, which piston rod 5 connects a plunger 7 to the combustion piston 17. The plunger 7 can move in a reciprocating manner in a second cylinder 15. Together with the closed end of the second cylinder 15, the plunger 7 forms a first pressure chamber 8. A seal 6 is arranged around the piston rod 5. The oil which is scraped off by the seal 6 is discharged via a leakage oil line 16.

The assembly comprising the combustion piston 17 and the plunger 7 moves freely in a reciprocating manner under the influence of the forces exerted thereon. These forces are produced by the pressure of the gases in the combustion space 2 and the pressure of the fluid in the first pressure chamber 8. For compression of the combustion air, fluid is fed into the first pressure chamber 8 via a compression line 14. The pressure of the fluid in the first pressure chamber 8 during the movement of the combustion piston 17 from the bottom dead center toward the top dead center determines the amount of energy which is supplied to the combustion air during the compression and therefore the combustion. The pressure of the fluid in the first pressure chamber 8 during the movement of the combustion piston 17 from the top dead center toward the bottom dead center determines the amount of energy which is extracted. By making a control unit set the pressure of the fluid in the first pressure chamber 8 correctly, it is possible for the combustion piston 17 to move in such a manner that the combustion takes place optimally. To ensure that this process takes place correctly, sensors which are able to detect the position of the plunger 7 in the vicinity of the bottom dead center are positioned in a known way.

To control the fluid pressure in the first pressure chamber 8, the compression line 14 is coupled to one of the ports of the hydraulic transformer 11 A hydraulic transformer of this type is known, for example, from patent applications WO 9731185, WO 9940318 and WO 9951881, in the name of the same applicant, and the contents of which are hereby deemed to be incorporated. The hydraulic transformer 11 is coupled to a low-pressure connection T via a low-pressure line 13 and to the high-pressure connection P via a high-pressure line 10. If appropriate, the low-pressure line 13 is provided with a low-pressure accumulator 12, and if appropriate the high-pressure line 10 is provided with a high-pressure accumulator 9, in order to reduce pressure pulsations in the lines 10 and 12, respectively.

The hydraulic transformer 11 is provided with an adjustment device which is able very quickly to set the pressure in the compression line 14 at a medium pressure C. During compression stroke A, that is to say the movement of the combustion piston 17 from the bottom dead center toward the top dead center, the pressure in the first pressure chamber 8 is the medium pressure C which is, for example, approximately the mean of the pressure in the high-pressure connection P and the low-pressure connection T. When the combustion piston 17 is at the top dead center, the hydraulic transformer 11 is adjusted so that the pressure in the first pressure chamber 8 becomes equal to or slightly higher than the pressure in the high-pressure connection P. When the combustion piston 17, after the expansion stroke B, has moved back to the bottom dead center, the hydraulic transformer 11 is adjusted in such a manner that the pressure in the first pressure chamber 8 becomes approximately equal to zero, so that the combustion piston 17 comes to a standstill. If appropriate, the changes in the pressure in the first pressure chamber 8 take place more gradually during the piston movement, in which case the control unit regulates the settings of the hydraulic transformer 11 and therefore of the pressure in the first pressure chamber 8 on the basis of the desired release of energy to or uptake of energy from the combustion piston 17.

As a result of the hydraulic transformer 11 being used, it is also possible for the pressure in the first pressure chamber 8, during the movement of the combustion piston 17 toward the bottom dead center, to be kept at a lower level than the pressure in the high-pressure connection P. The amount of energy extracted from the combustion piston 17 is then also lower and the amount of fuel supplied is likewise lower. As a result, it is thus possible to make the free-piston unit function on part-load for each stroke, which may be an advantage during start-up, when the free-piston unit 3 is cold, or, for example, under zero load. In other situations too it may be advantageous that the power of the free-piston unit 3 can be regulated in two ways, both by controlling the stroke frequency and by controlling the amount of fuel supplied and therefore the amount of energy converted for each stroke.

For the free-piston unit 3 to operate correctly, the control system is designed as an electronic system and also encompasses the control unit of the fuel-injection system 1 and of the hydraulic transformer 11. For the purposes of control, if appropriate temperature sensors are arranged in the free-piston unit 3 and pressure sensors are arranged in the high-pressure connection P and the low-pressure connection T. Other sensors which are required for correct operation are also coupled to the control unit, in the manner which is known to the person skilled in the art.

Figure 2:
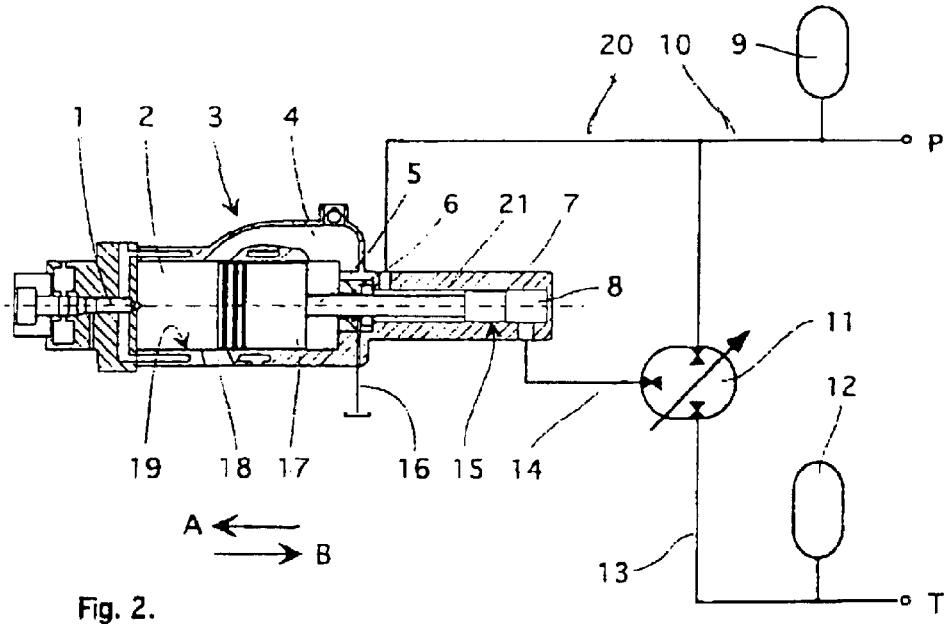
FIG. 2 shows a diagrammatic cross section through a second embodiment of a free-piston unit with a hydraulic transformer.

FIG. 2 shows an improved embodiment of the free-piston unit 3 having a second pressure chamber 21, which is connected to the high-pressure connection P via a coupling line 20. The fluid which is present in the second pressure chamber 21 exerts a force on the plunger 7 which is directed away from the combustion space 2, so that the combustion piston 17 will move toward the bottom dead center. As a result, it is easier, if no ignition of the fuel has taken place after compression and fuel injection, for the combustion piston 17 to be moved back to the bottom dead center for a further stroke.

Figure 3:
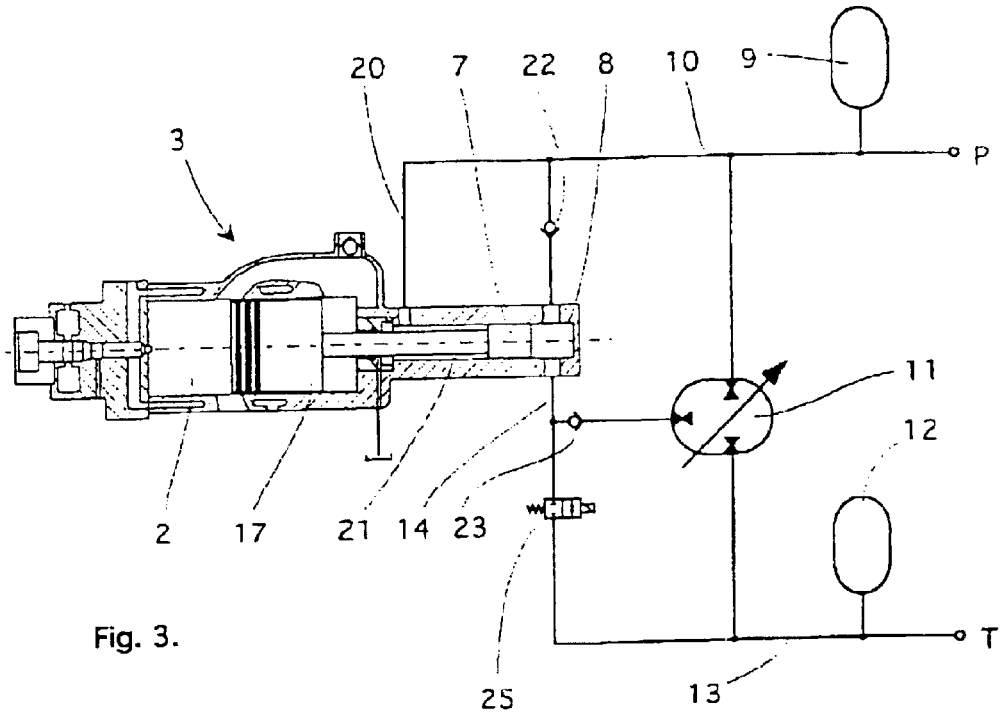
FIG. 3 shows a diagrammatic cross section through a third embodiment of a free-piston unit with a hydraulic transformer.

FIG. 3 shows an embodiment of the free-piston unit 3 in which the first pressure chamber 8 is connected, via a nonreturn valve 22, to the high-pressure connection P. A nonreturn valve 23 is also positioned in the compression line 14. During the expansion stroke, as the combustion piston 17 moves toward the bottom dead center, fluid will be pumped out of the first pressure chamber 8 directly to the high-pressure connection P, via the nonreturn valve 22. The high pressure (peak) which occurs in the first pressure chamber 8 is blocked by the nonreturn valve 23. This reduces the load on the hydraulic transformer 11, which can therefore be of smaller design.

While the combustion piston is stationary at the bottom dead center, it is possible for fluid Lo leak out of the second pressure chamber 21 to the first pressure chamber 8 past the plunger 7. As a result, the plunger 7 will move at creep speed toward the top dead center, which is undesirable. To prevent this creep, the first pressure chamber 8 is connected to the low-pressure connection T via an anti-creep valve 25. The anti-creep valve 25 is opened if the combustion piston is to remain stationary at the bottom dead center for a prolonged period.

Instead of using the hydraulic transformer 11, in another embodiment, during the compression stroke the pressure chamber 8 can be provided with fluid under a possibly adjustable pressure in another way. Instead of the hydraulic transformer 11, it is possible to use a pump for supplying fluid to the first pressure chamber 8, which pump if appropriate may have an adjustable output. This pump may be a rotary pump or, if appropriate, a linear piston. The pump can be driven by a rotating hydraulic motor or, if appropriate, a hydraulic cylinder. The pump and/or hydraulic motor may be provided with adjustment means, so that the output or the pressure to be supplied can be adjusted.

Figure 4:
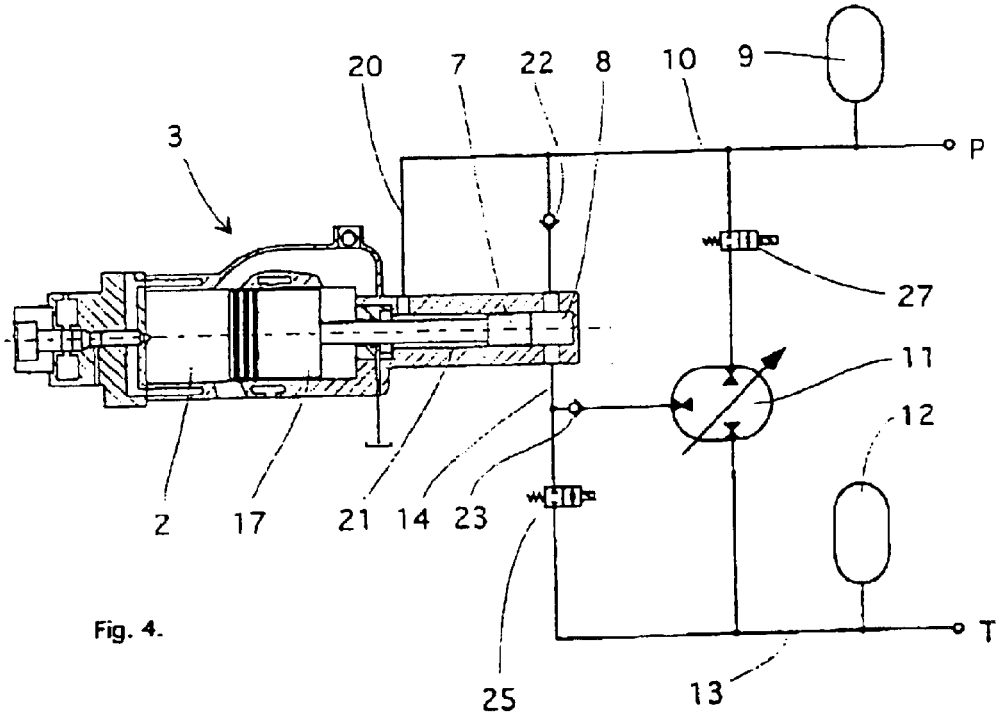
FIG. 4 shows a diagrammatic cross section through a fourth embodiment of a free-piston unit with a hydraulic transformer.

FIG. 4 shows another embodiment in which the supply of fluid to the first pressure chamber 8 is switched using a starting valve 27 which is positioned in the line leading from the high-pressure connection P to the hydraulic transformer 11. In this case, the setting of the hydraulic transformer 11 remains more or less constant and is dependent on the combustion process in the combustion space 2. If the combustion piston 17 is to execute a compression stroke, the starting valve 27 is opened. If the combustion piston 17 is to remain at the bottom dead center, the starting valve 27 is closed.

Figure 5:
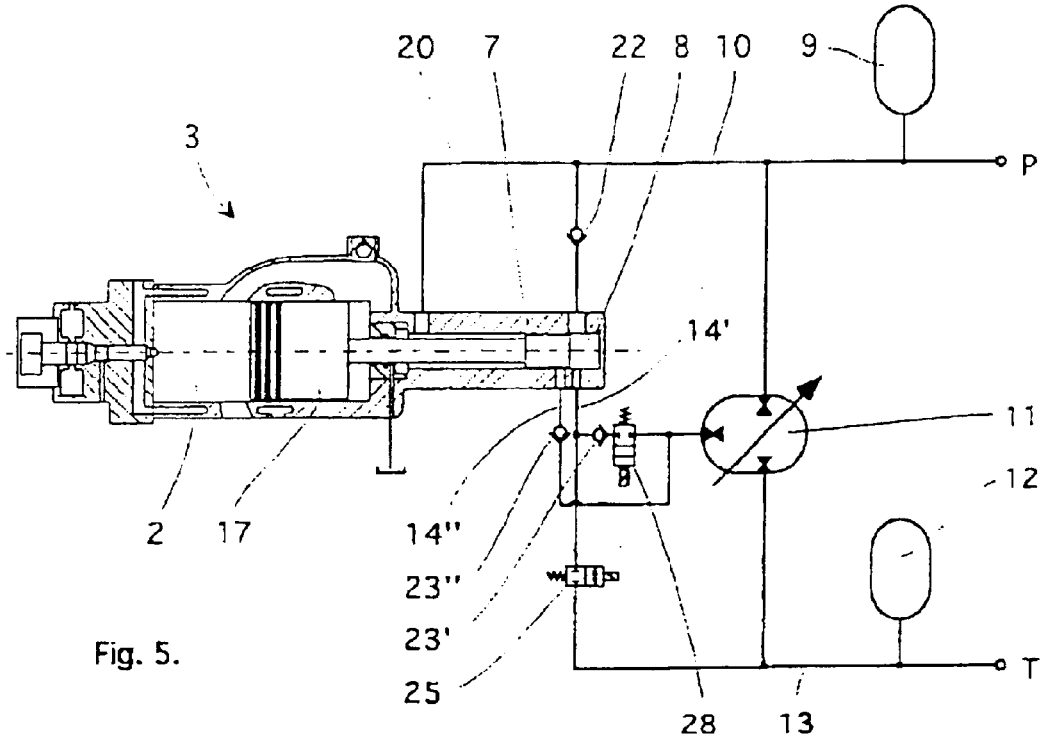
FIG. 5 shows a diagrammatic cross section through a fifth embodiment of a free-piston unit with a hydraulic transformer.

FIG. 5 shows an embodiment with a starting valve 28 in the compression line 14 between the hydraulic transformer 11 and the first pressure chamber 8. In the embodiment shown, the compression line 14 is also split into two connections to the first pressure chamber 8, the compression line 14" being closed by the plunger 7 when the combustion piston 17 is in the bottom dead center. The starting valve 28 is positioned in the compression line 14' which maintains an open connection with the first pressure chamber 8. A nonreturn valve 23' and 23" is positioned in each compression line 14' and 14" respectively. Splitting the compression line 14 into a connection which can be closed off by the plunger 7 and a connection which remains open allows the starting valve 28 to be of smaller design while the flow losses remain limited.

Figure 6:
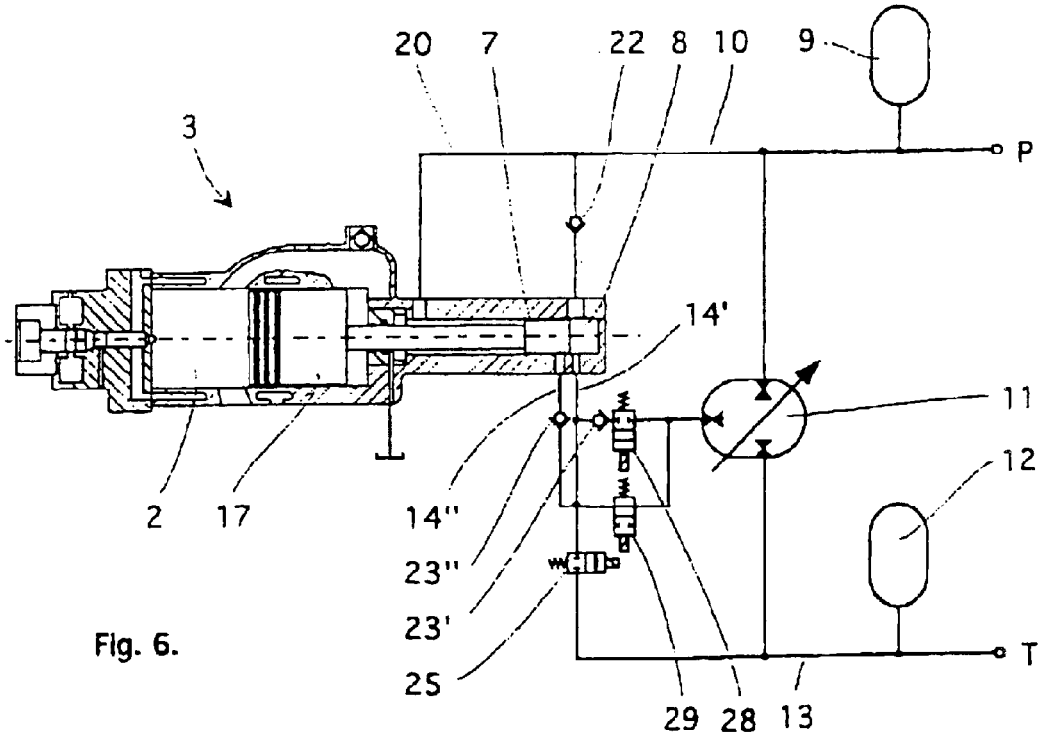
FIG. 6 shows a diagrammatic cross section through a sixth embodiment of a free-piston unit with a hydraulic transformer.

FIG. 6 shows an embodiment in which a valve 29 is accommodated in the compression line 14" which can be closed off by the plunger 7. As a result, it is possible to close the compression line 14" and to depressurize the first pressure chamber 8 by opening the valve 25. As a result, it is possible, in the event of misfiring, to move the combustion piston 17 toward the bottom dead center without having to change the setting of the hydraulic transformer 11.

Figure 7:
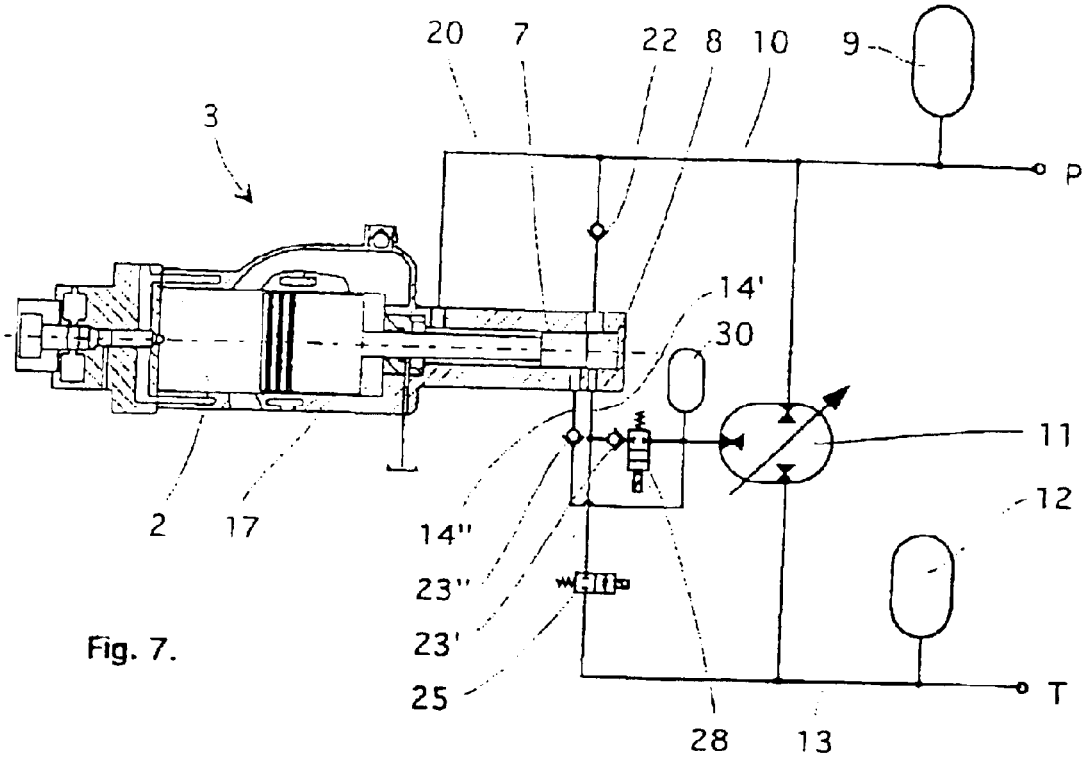
FIG. 7 shows a diagrammatic cross section through a seventh embodiment of a free-piston unit with a hydraulic transformer.

FIG. 7 shows an embodiment in which the compression line 14 is connected to an accumulator 30. As a result, the supply of fluid to the first pressure chamber 8 can be primed rapidly, with the mass to be accelerated being minimal and without the hydraulic transformer 11 firstly having to be brought up to speed.

Figure 8:
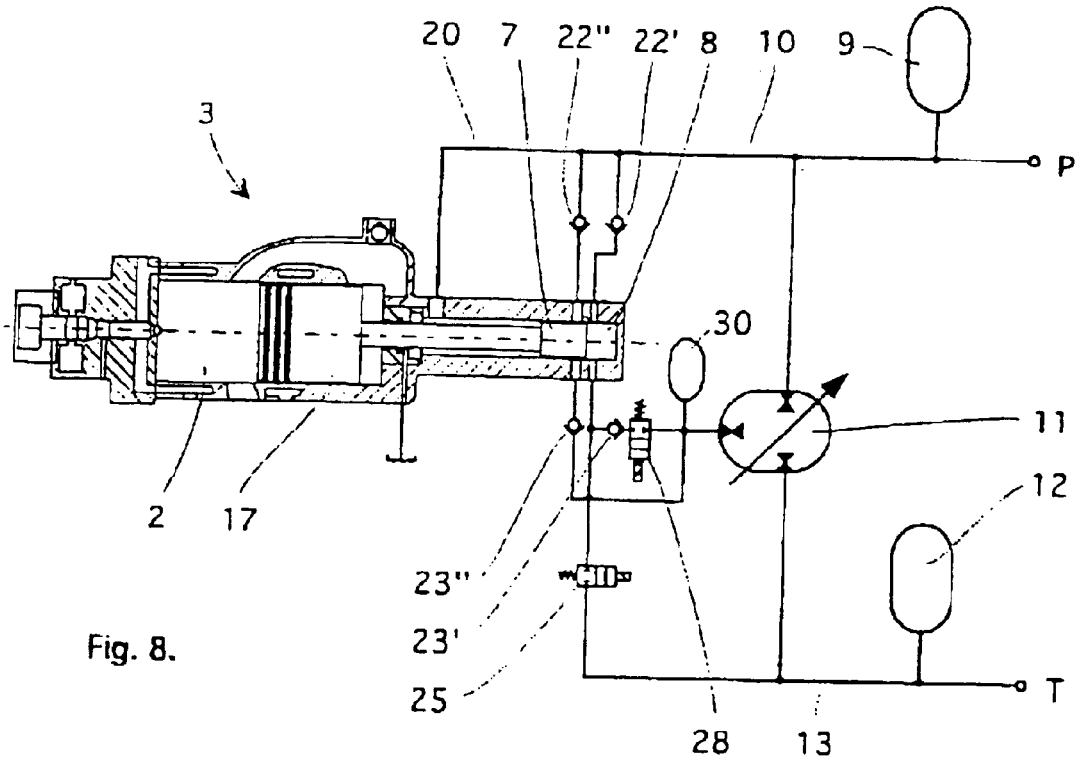
FIG. 8 shows a diagrammatic cross section through an eighth embodiment of a free-piston unit with a hydraulic transformer.

FIG. 8 shows an embodiment in which the connection of the first pressure chamber 8 to the high-pressure connection P is designed with two lines and two nonreturn valves 22' and 22". When the combustion piston 17 is in the vicinity of the bottom dead center, the plunger 7 closes the line to the nonreturn valve 22". It is thus possible to design the latter with a lower flow resistance, which limits losses, since it is not necessary for this nonreturn valve 22" to close rapidly.

Figure 9:
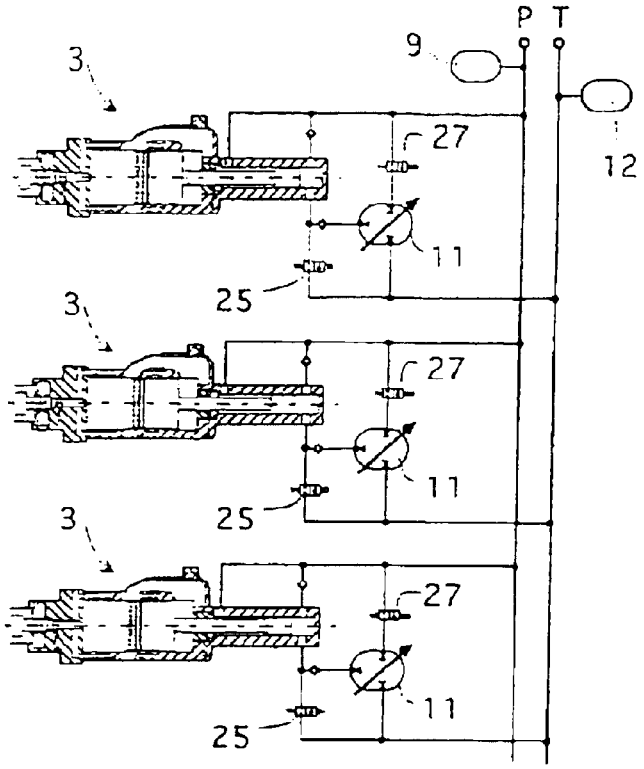
FIG. 9 shows a number of interacting free-piston units as shown in FIG. 4.
Figure 10:
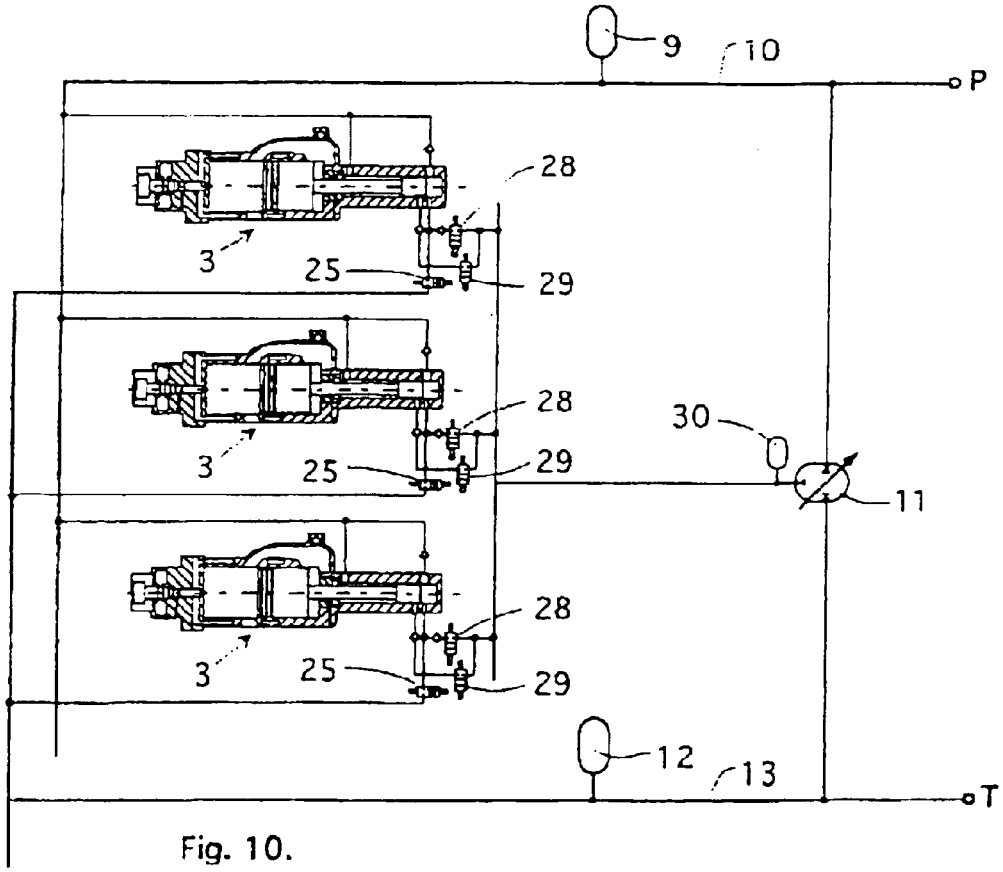
FIG. 10 shows a number of free-piston units which interact in an adapted way and as shown in FIG. 6.

FIGS. 9 and 10 show the use of a number of free-piston units 3 which are connected to the high-pressure connection P and the low-pressure connection T. The embodiment shown in FIG. 9 shows the free-piston unit 3 in the design shown in FIG. 4. The control unit preferably switches the starting valves 27 in such a manner that the compression stroke A and therefore the ignition processes in the combustion space take place successively, so that the flow of fluid to the high-pressure connection P takes place as evenly as possible. The embodiment shown in FIG. 10 shows free-piston units 3 in the design shown in FIG. 6. The free-piston units 3 have a common hydraulic transformer 11, the level of the medium pressure C in the compression line 14 being adapted to the optimum action of the free-piston units 3.

FIGS. 11–15 show exemplary embodiments of the hydraulic part of the free-piston unit, predominantly illustrating the components which play a role in the generation of hydraulic pressure, so that inter alia the valves which are required to, for example, prevent creep of the free piston and to return the free piston to the starting position are not shown in further detail.

FIG. 11 shows an exemplary embodiment in which the fluid supplied by the unit is supplied directly to the high-pressure line 10 via a nonreturn valve 22. The medium pressure C supplied by the hydraulic transformer 11 is, via a medium-pressure line 32 and the accumulator 30, permanently present in the second pressure chamber 21 and, during the compression stroke, in the first pressure chamber 8. The force exerted on the plunger by the fluids present in the hydraulic part is therefore dependent on the medium pressure C in the medium-pressure line 32. In this exemplary embodiment, the flow of oil through the hydraulic transformer 11 is limited to the supply to the first pressure chamber 8, which supply takes place at relatively low pressure, so that the energy losses in the hydraulic transformer 11 are limited. Consequently, the efficiency of this embodiment is relatively high.

FIG. 12 shows an embodiment in which the starting and stopping of the free piston is carried out by means of a piston drive 31, a third pressure chamber 33 being used in a known way. The force exerted on the plunger 7 is dependent on the one hand on the pressure prevailing in the piston drive 31 and on the other hand on the medium pressure C prevailing in the medium-pressure line 32. The means for setting the pressure in the piston drive 31 are not shown in further detail. The fluid flowing to the first pressure chamber 8 is immediately sucked out of the low-pressure line 13 via the nonreturn valve 23 and is pumped to the high-pressure line 10 via the nonreturn valve 22 and the hydraulic transformer 11. The advantage of this embodiment is that the fluid supplied to the high-pressure line 10 is free of pulsations and that it is not necessary to position a high-pressure accumulator in the high-pressure line 10.

FIG. 13 shows an embodiment which is similar to the embodiment shown in FIG. 11, except that the piston drive 31 and the third pressure chamber 33 have been added. This embodiment combines relatively high efficiency with good controllability of the energy supplied to the plunger 7.

FIG. 14 shows an exemplary embodiment which is similar to the embodiment shown in FIG. 13 and in which the second pressure chamber 21 is also connected to the high-pressure line 10 via a nonreturn valve 22*b*. As a result, fluid is supplied to the high-pressure line 10 during the compression stroke and during the expansion stroke, so that the pulsations occurring in this supply of fluid are smaller while the efficiency benefit is retained.

FIG. 15 shows an exemplary embodiment which is similar to the embodiment shown in FIG. 14, with fluid being pumped to the high-pressure line 10 both during the compression stroke and during the expansion stroke.

FIG. 16 shows an exemplary embodiment of a free-piston unit in which two combustion pistons 34 are coupled via the piston rod 5, which in this case is continuous and to which the plunger 7 is attached. Together with a cylinder, the plunger 7 forms a right-hand pressure chamber 35 and a left-hand pressure chamber 36. The pressure chambers 35 and 3*c* are connected to the high-pressure line 10 via nonreturn valves 22. The power to be supplied to the combustion pistons 34 during a compression stroke can be adjusted by the right-hand pressure chamber 35 and the left-hand pressure chamber 36 being connected to the medium-pressure line 32, the medium pressure C of which can be set by the hydraulic transformer 12, via the nonreturn valves 23.

The auxiliary equipment required is not shown in the various exemplary embodiments. This auxiliary equipment may comprise, inter alia, a cooling fan, a generator and possibly a pump. Equipment of this nature is preferably driven in rotation, and to this end the rotor which forms part of the hydraulic transformer 11 is provided with an output shaft. The power required for the auxiliary equipment is proportional to the power which is to be supplied by the unit. The power to be supplied by the unit is proportional to the rotation of the hydraulic transformer 11, so that using the rotation or the hydraulic transformer to drive the auxiliary equipment avoids losses caused by zero load and leads to higher efficiency.

To increase the stability of the hydraulic transformer 11, it is also possible to provide the rotor with an output shaft and to couple the latter to a rotatable mass. This provides some degree of damping of changes in the rotational speed of the rotor, so that the hydraulic transformer can be controlled more accurately.

The design details which are shown in the various embodiments can also be used in other embodiments, in which case similar effects are achieved in this use as well.

What is claimed is:

1. A free-piston unit for converting fuel into hydraulic energy by displacing fluid from a first fluid source which is at a first, low pressure to a second fluid source which is at a second, high pressure, comprising a combustion part, a hydraulic part and a control unit, the combustion part comprising a first cylinder with a combustion piston and a combustion space the volume of which becomes smaller during a compression stroke and becomes larger during an expansion stroke, a fuel-supply system for supplying fuel, the hydraulic part comprising a plunger which is coupled to the combustion piston and can move in at least one cylinder thus forming one or more pressure chambers on which fluid which is present in the pressure chamber(s) during the compression stroke and during the expansion stroke, exerts a force directed toward the combustion space, characterized in that adjustable pressure conversion means for setting a third pressure for fluid which is to be displaced via the pressure chamber from the first fluid source to the second fluid source.

2. The free-piston unit as claimed in claim 1, wherein means are present for setting the energy which is supplied to the plunger during the compression stroke.

3. The free-piston unit as claimed in claim 1, wherein the adjustable conversion means comprise a hydraulic transformer which is connected to the first fluid source and the second fluid source.

4. The free-piston unit as claimed in, wherein the hydraulic transformer is provided with a rotor for enabling unlimited fluid flows to be achieved.

5. The free-piston unit as claimed in claim 4, wherein the rotor functions as a motor for driving auxiliary equipment.

6. The free-piston unit as claimed in claim 4, wherein the rotor is coupled to a rotatable mass for stabilizing its rotational speed.

7. The free-piston unit as claimed in claim 3, wherein the supply of fluid from the first fluid source to the second fluid source takes place via at least one pressure chamber and the hydraulic transformer.

8. The free-piston unit as claimed in claim 3, wherein the supply of fluid from the first fluid source to a pressure chamber takes place via the hydraulic transformer.

9. The free-piston unit as claimed in claim 3, wherein discharge of fluid from a pressure chamber to the second fluid source takes place via the hydraulic transformer.

10. A free-piston unit for converting fuel into hydraulic energy as claimed in claim 1, comprising at least two free-piston units, wherein the control unit enables the free piston units to successively execute a compression stroke.

* * * * *